United States Patent [19]

Harrison

[11] Patent Number: 4,805,818

[45] Date of Patent: Feb. 21, 1989

[54] KNIFE SHEATH AND TOOL DEVICE

[76] Inventor: Dan W. Harrison, Rte. 1, Box 507, Brownsboro, Tex. 75756

[21] Appl. No.: 64,003

[22] Filed: Jun. 19, 1987

[51] Int. Cl.[4] ..... B26B 29/02

[52] U.S. Cl. ..... 224/232; 7/129; 30/143

[58] Field of Search ..... 224/232, 904, 242, 252, 224/251, 253, 914; 7/128, 129, 158, 134; 30/151, 146, 148, 164, 143, 142; 81/489, 490

[56] References Cited

U.S. PATENT DOCUMENTS

| | | |
|---|---|---|
| 519,710 | 5/1894 | Highsmith . |
| 883,648 | 3/1908 | Landers . |
| 896,746 | 8/1908 | McCarty . |
| 1,277,031 | 8/1918 | Bigos . |
| 1,287,569 | 12/1987 | Bizon . |
| 2,833,036 | 5/1958 | Aciego . |
| 3,842,458 | 10/1974 | Bauer . |
| 4,122,569 | 10/1978 | Hitchcock . |
| 4,720,030 | 1/1988 | Petrovich ..... 7/129 X |

*Primary Examiner*—Werner H. Schroeder

*Attorney, Agent, or Firm*—Richards, Harris, Medlock & Andrews

[57] ABSTRACT

A knife sheath device includes a gripping or cutting type of tool such as a pair of pliers or wire cutters. The device includes a sheath pivotally mounted upon a back plate with the back plate and sheath cooperating to form and operate the tool. Portions of the tool are formed or attached to the sheath and also to the back plate, and the tool is operated by pivoting the sheath in relation to the back plate.

19 Claims, 2 Drawing Sheets

FIG. 3
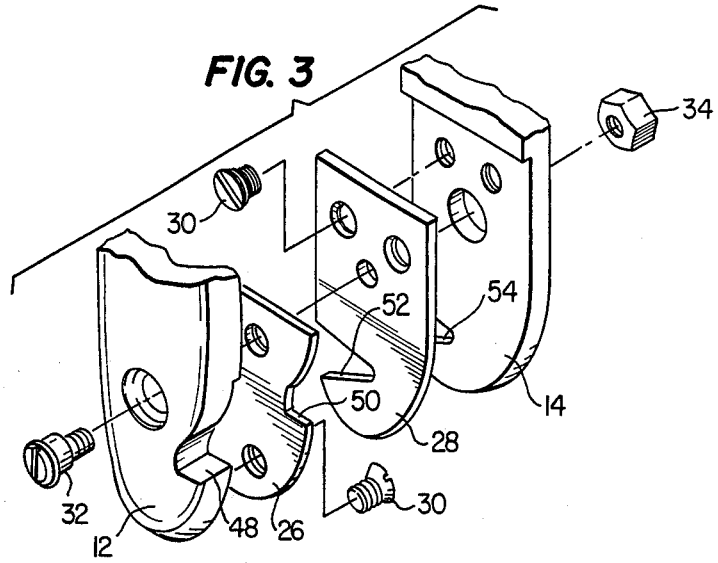
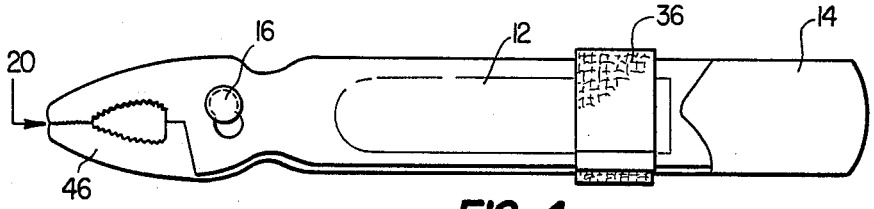
FIG. 4
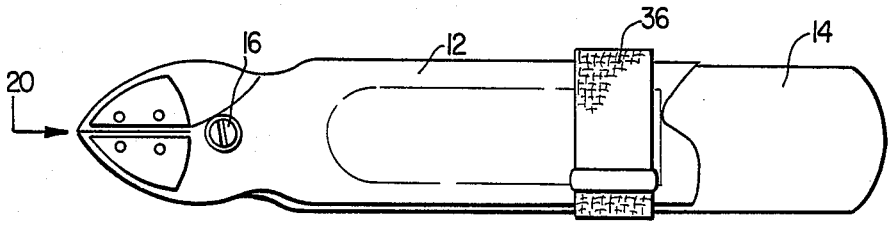
FIG. 5
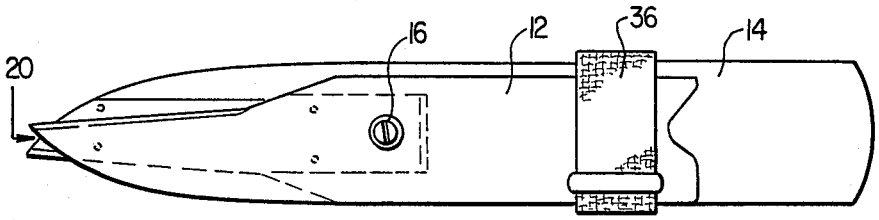
FIG. 6

KNIFE SHEATH AND TOOL DEVICE

TECHNICAL FIELD

The invention relates to a knife sheath and tool device that includes a sheath pivotally mounted on a back plate such that the sheath and back plate cooperate to form a gripping or cutting tool. The sheath and back plate serve as handles for using the tool which is operated by pivoting the sheath in relation to the back plate.

BACKGROUND

Outdoorsmen commonly carry large hunting knives for various purposes such as skinning game, cleaning fish, cutting ropes, etc. Similarly, combat soldiers typically carry knives or bayonets for use in hand-to-hand combat. These knives are usually carried in a sheath that hangs from the belt or that is worn around the leg so that the knife is readily accessible. Knives are frequently used as a multi-purpose tool because they are the only implements that are at hand when a tool is needed. Typically, knives are used for these various purposes because the proper tool is either not carried or is packed away in an inaccessible location.

Outdoorsmen and soldiers alike commonly have need for tools such as pliers, wire cutters, shears, grippers and clippers. By themselves, these tools are heavy and would be a burden to carry. If they are carried, they typically would be carried as part of a tool kit that is stored with the other equipment and is usually not readily accessible. It would be beneficial, therefore, to have such a tool readily available as part of the regular equipment carried by the outdoorsmen or soldier without having to carry a separate tool. The present invention provides a device that includes a tool such as a pair of pliers or wire cutters as part of a knife sheath that will accommodate a large hunting or combat knife and that can be worn on a belt or around the leg so that it is readily accessible.

SUMMARY OF THE INVENTION

The present invention provides a device that is worn and used as a typical knife sheath but that also provides a readily accessible gripping or cutting tool such as a pair of pliers or wire cutters. The device includes a knife sheath with a closed end, an open end and a blade cavity for receiving a knife blade, a back plate and tool means. The sheath is pivotally mounted on the back plate such that the sheath can move relative to the back plate. The tool means is positioned in the sheath and in an associated portion of the back plate. The sheath and the back plate cooperate to operate the tool means by pivoting the sheath about the pivot point in relation to the back plate. The tool means may be attached to the sheath and back plate, or it may actually be formed in the sheath and back plate. The tool means may be used with or without the knife being in the sheath.

The device of the present invention may include additional features which increase its usefulness. The device may include a retaining strap or other means for retaining the sheath in an aligned position with the back plate. To use the tool, it is simply necessary to release the retaining strap and pivot the sheath in relation to the blade. The invention may also include means for securing the knife in the sheath and means for attaching the device to a belt or around the leg of a person.

The present invention may include any tool means that form tools which utilize a pivotal joint such as pliers, wire cutters, grippers, shears, tin snips, or clippers. Those skilled in the art will recognize that other tool means may be incorporated into the present invention.

BRIEF DESCRIPTION OF THE DRAWINGS

The foregoing and additional details and advantages of the invention will be more apparent when the following detailed description is read in conjunction with the accompanying drawings, wherein like reference characters denote like parts in all views and wherein:

FIG. 3 is an exploded view of the cutting and pivoting mechanisms of the embodiment shown in FIGS. 1 and 2;

FIG. 4 illustrates a second embodiment of the invention incorporating pliers as the tool formed by the sheath and back plate;

FIG. 5 illustrates a third embodiment of the invention incorporating a different version of wire cutters or diagonals as the tool formed by the sheath and back plate; and FIG. 6 illustrates a fourth embodiment of the invention incorporating scissors or game shears as the tool being formed by the sheath and back plate.

DETAILED DESCRIPTION

The present invention provides a knife sheath device that includes a sheath pivotally mounted upon a back plate such that the sheath and back plate cooperate to form a tool such as a gripping tool, e.g., pliers or wire cutters, or cutting tool, such as scissors or clippers, or any other tool that has two or more pieces attached in a pivot. The portions of the sheath and the back plate that are below the pivot point form the tool jaws. The portions above the pivot point provide handles to operate the tool. The tool surfaces, such as cutting surfaces, may be attached to or formed in the sheath and back plate. The tool is operated by pivoting the sheath in relation to the back plate and may be used either with the knife in the sheath or with the knife removed from the sheath.

Figure 1:
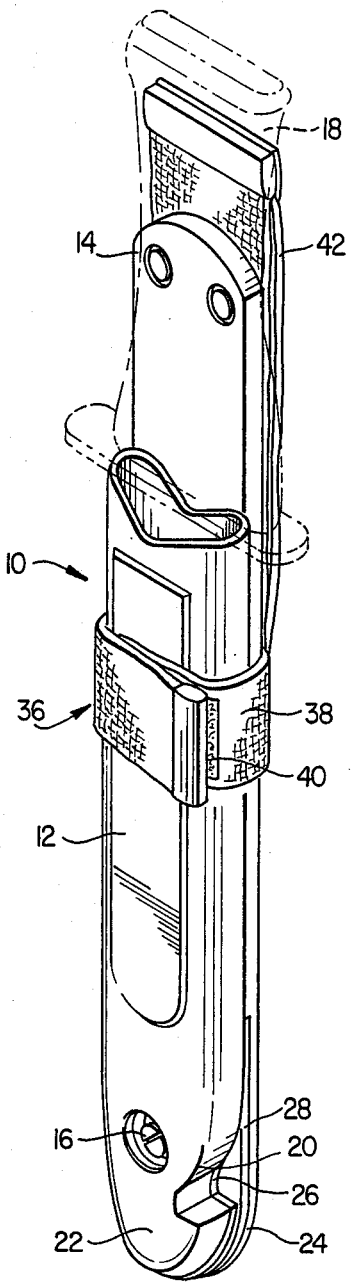
FIG. 1 is a perspective view of one embodiment of the present invention showing wire cutters as the tool formed by the cooperation of the sheath and back plate.

Referring to FIG. 1, the knife sheath device of the present invention, generally indicated as 10, includes a knife sheath 12 that is attached to a back plate 14. The sheath 12 is attached to the back plate 14 by pivot means 16 such that the sheath 12 may be pivoted or rotated in relation to the back plate 14. The pivoting or rotating of the sheath 12 to a position similar to that shown in FIG. 2 allows operation of the tool means 20. FIG. 1 shows the position of a knife handle 18 in phantom as it would appear when a knife is inserted into sheath 12. The insertion of a knife into sheath 12 does not affect the movement of the sheath or the operation of the tool means.

Figure 2:
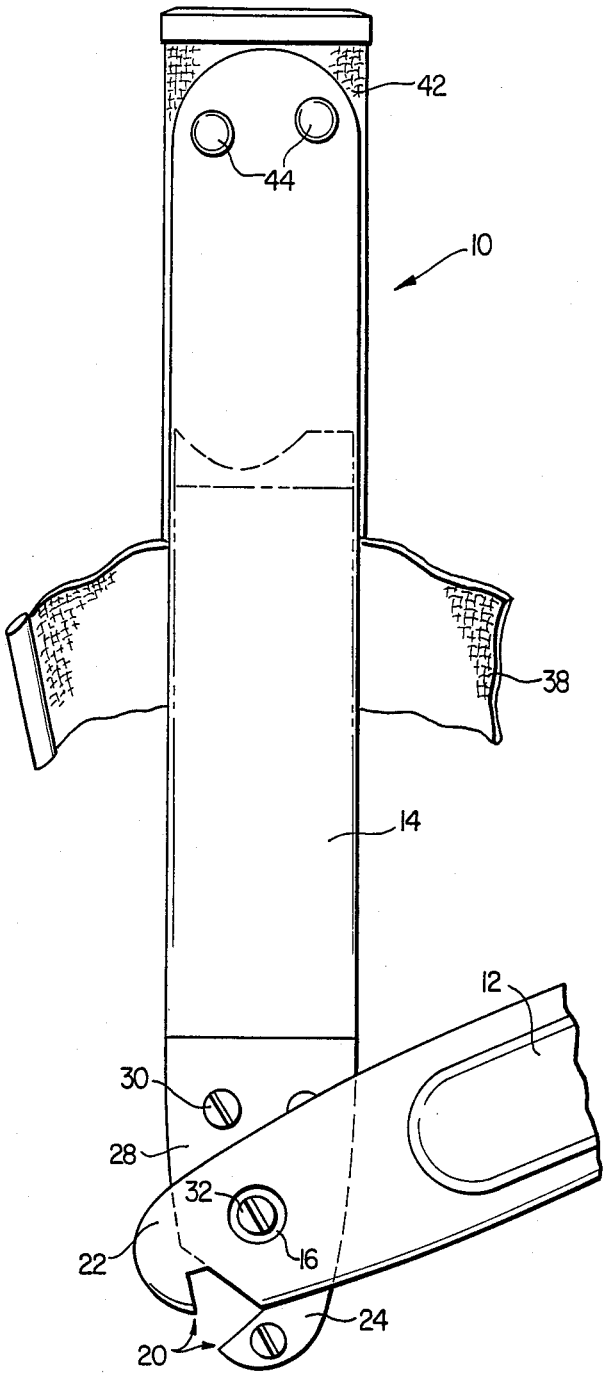
FIG. 2 is a front view of the embodiment of FIG. 1 with the sheath rotated to a position so that the device may be used as wire cutters.

FIGS. 1 and 2 illustrate one embodiment of the tool means 20 that may be included in the invention. FIGS. 1 and 2 show wire cutters that are formed in the tool end 22 of sheath 12 and the tool end 24 of back plate 14. The tool ends are those portions of the sheath and back plate that are below the pivot point and are opposite from the handle ends. The pivot means 16 is located between the tool end and the handle end on both the sheath and the back plate. The type of tool means 20 determines the placement of the pivot means 16 along the length of the sheath and back plate.

While the embodiments shown in FIGS. 1 through 6 illustrate the pivot means 16 as located between the tool end and the handle end, it will be appreciated by those skilled in the art that in some cases, the tool means may be positioned on the same side of pivot means 16 as the handle ends of the sheath and back plate. For example, cooperating notches, such as notches 48 and 50 in sheath 12 and blade 26, respectively, and notches 52 and 54 in back plate 14 and blade 28, may be positioned on opposite edges of back plate 14 and sheath 12 but on the same side of pivot 16 as the handle ends thereof.

The tool means 20 may include attached pieces that are added to provide satisfactory operation of the tool. As shown in FIG. 3, cutting blades 26 and 28 are attached to the sheath 12 and back plate 14, respectively, by screws 30 to provide a durable surface for cutting wire. Similarly, other types of tool means may require additional features attached to the sheath and back plate to provide for or to enhance the operation of the tool.

FIG. 3 also shows the pivot means as including a shoulder bolt 32 and nut 34 in the embodiment of the invention shown in FIGS. 1 and 2. The pivot means may vary depending on the type of tool means included in the device, but it still must allow relative movement of the sheath and back plate.

FIG. 1 illustrates one embodiment of a retaining means 36 which serves to retain sheath 12 in a position aligned with back plate 14. FIG. 1 shows the retaining means as including a strap 38 that encircles both the sheath 12 and the back plate 14. The ends of strap 38 are attached to each other by means of associated releasable adhering strips 40, such as those sold under the trademark Velcro, in the embodiment shown. The Velcro strips may be replaced by a snap or any other securing or fastening devices. The retaining means 36 may comprise any type of retention device.

The embodiment shown in FIGS. 1 and 2 also includes a back strap 42 which serves as an attachment means for attaching the device 10 to a belt. Back strap 42 is attached to back plate 14 by rivets 44 near the top of back plate 14 and again in the middle of the back plate (only one set of rivets are shown). Retaining straps 38 may be sewn or otherwise attached to back strap 42. Back strap 42 consists of a closeable loop which may be fastened closed around a belt so that the sheath 12 hangs at the waist of a person carrying it. The attachment means may be varied to provide for attachment of the device to other objects besides a belt such as a knapsack or around the leg. The attachment means allow the device to be worn such that the tool and the knife are both readily accessible.

As shown in FIG. 2, the tool means 20 is operated by simply unfastening the retaining means 36 and and grasping the handle ends of the sheath and the back plate and pivoting the sheath 12 about the pivot means 16 to open the jaws of the tool means. The sheath 12 and the back plate 14 provide handles for operating the tool means. The tool means is operated like any other pivoting tool, such as clippers or pliers, by moving the handles relative to each other about the pivot means.

The tool means 20 may comprise any type of tool that includes a pivot point. FIGS. 4, 5 and 6 illustrate various tools that may be incorporated into the present invention. FIG. 4 shows the tool means as a pair of pliers 46. The pliers are worked as described above, and the pivot means may be the typical nut and bolt used in a pair of ordinary pliers. The pivot means may also be shiftable as in a pair of pliers to allow for greater gripping capacity. FIG. 5 illustrates the tool means as being a pair of snippers or wire cutters. FIG. 6 shows the tool means as being a pair of scissors or game shears. As mentioned, the tool means may include other types of tools that include two or more pieces attached together that are operated by pivoting handles about a pivot means such as any gripping, clipping or cutting tool.

The tool means may be formed in the sheath and back plate or may be attached to the sheath and back plate. FIG. 3 shows the hardened cutting blades 26 and 28 being attached to the sheath and back plate. Notches 48 and 50 are also formed in the sheath 12 and blade 26 to cooperate with notches 52 and 54 in back plate 14 and blade 28 to accommodate the positioning of a wire so that it may be cut by the blades. Similarly, the cutting edges for the tools shown in FIGS. 5 and 6 are also attached to the tool ends of the sheath and back plate. It is important that these tool means be securely attached to the sheath and back plate so as to be able to withstand the forces associated with the working of these tools.

Similarly, it is important that the sheath and back plate be constructed of sturdy materials. The sheath and back plate must be capable of withstanding forces in the operation of the tool as well as various blows received while the device is carried about by a soldier or outdoorsmen. The preferred materials would include metals and high tensile strength plastics.

Although preferred embodiments of the invention have been described in the foregoing detailed description and illustrated in the accompanying drawings, it will be understood that the invention is not limited to the embodiments disclosed, but is capable of numerous rearrangements, modifications, and substitutions of parts and elements without departing from the spirit of the invention. The present invention is therefore intended to encompass such rearrangements, modifications and substitutions of parts and elements as fall within the scope of the present invention.

I claim:

1. A knife sheath device comprising a back plate, a sheath and tool means, said sheath having a closed end, an open end, and a blade cavity, said cavity adapted for receiving a knife blade, said sheath being pivotally mounted on said back plate, and said tool means being positioned in a portion of said sheath and said back plate such that said sheath and said back plate cooperate in the operation of said tool means, said back plate extending at least the length of said sheath.

2. The device of claim 1 wherein said tool means is adjacent the closed end of said sheath.

3. The device of claim 1 wherein said tool means is operated by pivoting said sheath in relation to said back plate.

4. The device of claim 1 wherein said tool means defines a tool selected from the group consisting of wire cutters, pliers, grippers, scissors, diagonals and game sheers.

5. The device of claim 1 further comprising retention means for retaining said sheath in a position substantially aligned with said back plate.

6. The device of claim 1 further comprising attachment means for attaching said device to another object.

7. The device of claim 1 further comprising securing means for securing a knife in said sheath.

8. A knife sheath device comprising:

a sheath having a closed end, an open end, and a blade cavity adapted for receiving a knife blade;

a back plate extending at least the length of said sheath;

pivot means for securing said sheath to said back plate such that said sheath pivots about said pivot means in relation to said back plate; and tool means attached to said sheath and to said back plate, and said tool means being operated by pivoting said sheath about said pivot means in relation to said back plate.

9. The device of claim 8 wherein said pivot means pivotally connects said sheath and said back plate intermediate of the ends thereof and said tool means is attached to said sheath and back plate on the side of said pivot means opposite the open end of said sheath.

10. The device of claim 8 wherein said pivot means includes a shoulder bolt and a locking nut.

11. The device of claim 8 wherein said tool means defines a tool selected from the group consisting of wire cutters, pliers, scissors, diagonals, and game shears.

12. The device of claim 8 further comprising retention means for retaining said sheath in a position substantially aligned with said back plate.

13. The device of claim 8 further comprising attachment means for attaching said device to another object.

14. The device of claim 8 further comprising securing means for securing a knife blade in said sheath.

15. A knife sheath device comprising:

a sheath having a closed end, an open end and a blade cavity adapted for receiving a knife blade;

a back plate having a tool end and a handle end extending at least the length of said sheath;

pivot means for pivotally attaching said sheath to said back plate near the closed end of said sheath; and tool means, attached to said sheath near the closed end of said sheath and to said back plate near said tool end, whereby said sheath and said back plate cooperate in the operation of the tool means, said tool means being operated by grasping the handle end of said back plate and the open end of said sheath and pivoting said sheath about said pivot means in relation to said back plate.

16. The device of claim 15 wherein said tool means defines a tool selected from the group consisting of wire cutters, pliers, scissors, diagonals and game shears.

17. The device of claim 15 further comprising retention means for retaining said sheath in a position substantially aligned with said back plate.

18. The device of claim 15 further comprising attachment means for attaching said device to another object.

19. The device of claim 15 further comprising securing means for securing a knife in said sheath.

* * * * *